United States Patent [19]

Jaffe

[11] Patent Number: 4,585,120

[45] Date of Patent: Apr. 29, 1986

[54] GARMENT BAG CLOSURE

[76] Inventor: Max L. Jaffe, 1240 N. Homan Ave., Chicago, Ill. 60651

[21] Appl. No.: 638,282

[22] Filed: Aug. 6, 1984

Related U.S. Application Data

[63] Continuation-in-part of Ser. No. 521,270, Aug. 8, 1983, abandoned.

[51] Int. Cl.[4] ..... B65D 85/18

[52] U.S. Cl. ..... 206/279; 206/284; 206/286; 206/287.1

[58] Field of Search ..... 206/279, 282, 284, 285, 206/286, 287.1, 289, 290, 291; 224/901; 383/23

[56] References Cited

U.S. PATENT DOCUMENTS

| | | | |
|---|---|---|---|
| 2,378,665 | 6/1945 | Threeton | 206/286 |
| 2,606,636 | 8/1952 | Brarerman | 206/279 |
| 2,637,424 | 5/1953 | Duskin | 206/279 |
| 3,244,261 | 4/1966 | Herz | 190/111 |
| 3,929,224 | 12/1975 | Smith, Jr. | 383/23 |
| 4,386,724 | 6/1983 | Kotler | 224/901 |

*Primary Examiner*—William Price
*Assistant Examiner*—Brenda J. Ehrhardt
*Attorney, Agent, or Firm*—Emrich & Dithmar

[57] ABSTRACT

A garment bag with a front panel and a rear panel connected at the peripheries thereof by a gusset extending transversely between the front and rear panels at the tops thereof. The gusset has two end edges extending generally perpendicularly to the front and rear panels with VELCRO fastening material along the end edges on the inside facing surfaces thereof. A flap is attached to the rear panel and extends toward the front panel and has VELCRO fastening material on the surface thereof facing the first fastening material to trap and retain hangers inside the bag with the hanger hooks extending outside the bag.

9 Claims, 10 Drawing Figures

GARMENT BAG CLOSURE

CROSS-REFERENCE TO OTHER APPLICATION

This application is a continuation-in-part of copending application Ser. No. 521,270, filed Aug. 8, 1983 now abandoned.

BACKGROUND OF THE INVENTION

This invention relates to garment bags and particularly to the type of garment bags used for short trips and the like and capable of carrying two to three suits or a comparable number of dresses. These bags are often carried onto airplanes to reduce the time required to check out baggage and can be hung on hangers to prevent the contents of the bag from becoming wrinkled. One significant problem with garment bags of the type is that the hangers, no matter how secured inside the bag, have a tendency to come loose during transit resulting in the clothes which are hung on the hangers falling into the bottom of the bag and becoming rumpled and wrinkled, thereby defeating one of the main purposes of these garment bags.

Another problem with garment bags of this type is providing a suitable hook by which the bag may be hung which is capable of functioning both as a hanging hook and also is capable of being stored out of the way when the bag is being carried by the user. A common hanger used in the art is a simple hook on the end of a chain connected to the bag which can be used to hang the bag over a pole or door when necessary. The problem with this type of element is that often times it falls out of the bag when the traveler is carrying the bag and can catch on various articles of furniture and the like causing a dangerous situation or in general is a nuisance. Another problem with hooks of the type disclosed is that some bags utilizing these hooks do not completely close at the top, thereby allowing rain or dirt to enter the bag soiling the clothes inside.

Another problem encountered with garment bags of this type is in packing clothing and in the bag. The single zipper located along the vertical axis of the bag does not allow much room for placing clothing in the bag and, therefore, often results in wrinkled and unsuitable clothing.

SUMMARY OF THE INVENTION

A principal object of the present invention is to provide a closure for a garment bag which fixedly secures the hanger in the bag so that hangers will not dislodge during transit and fall to the bottom of the bag.

Yet another object of the present invention is to provide a closure for a garment bag which maintains the hangers in position so that the hooks of the hangers extend outside the bag while the top of the bag can be closed.

Still another object of the invention is to provide a garment bag closure which substantially closes the top of the bag.

Another object of the invention is to provide a garment bag with dual zippers in the front panel positioned such that almost the entire front of the garment bag may be opened for easy access to the bag.

Yet another object of the present invention is to provide a garment bag comprising a front panel and a rear panel connected at the peripheries thereof, a gusset extending transversely between and connecting the front and rear panels at the tops thereof, the gusset having two end edges extending generally perpendicularly to the front and rear panels, first fastening means along the gusset end edges on the inside facing surfaces thereof, and a flap attached to the rear panel extending toward the front panel having second fastening material on the surface thereof facing the gusset, the gussets and the first fastening material thereon cooperating with the flap and the second fastening material thereon to trap and retain hangers inside the bag with the hanger hooks extending outside the bag, the front panel including a first and second zipper, the first zipper positioned along the top edge of the front panel adjacent the gusset and the two end edges, the second zipper lying oblique to the first zipper, the first and second zippers intersecting.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 1:
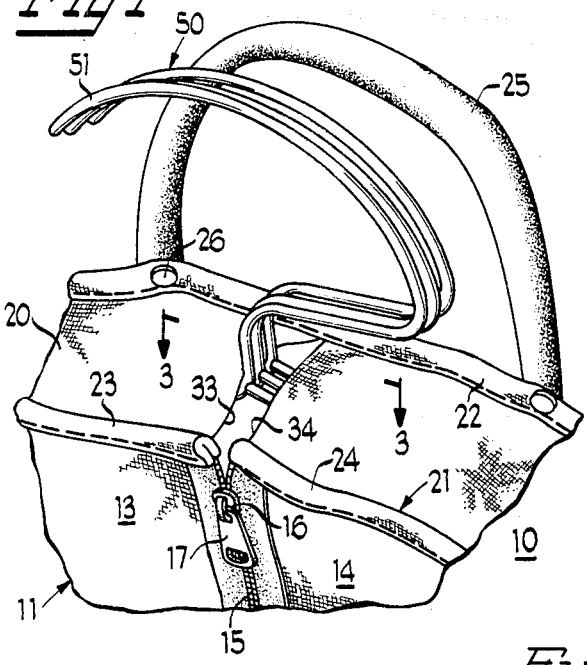
FIG. 1 is a elevational view of the top portion of a garment bag showing the hooks in position to be carried or hung for storage.

Referring now to the drawings, there is illustrated garment bag 10 having a front panel 11 and a rear panel 12 generally parallel to one another, the front panel 11 having a section 13 and a section 14 interconnected by a zipper 15. The zipper 15 is provided with the usual slider 16 and pull tab 17.

The front panel 11 and rear panel 12 are separated by a gusset 20 which connects the front panel and the rear panel at the peripheries thereof. The gusset 20 either extends completely around the periphery of the front and rear panels or only a portion thereof such as along the top. The gusset 20 is connected respectively to the front panel 11 and the rear panel 12 by means of a front welt 21 and a rear welt 22. The front welt 21 is divided into two sections 23 and 24 corresponding respectively to the sections 13 and 14 of the front panel 11. A handle 25 is securely connected to the rear welt 22 by rivets 26, thereby to provide carrying means for the garment bag 10, as will be explained.

Gusset 20 has two end edges 33 and 34 which extend generally perpendicularly between the front panel 11 and the rear panel 12, the inside facing surfaces of the gusset at the end edges 33, 34 being provided with strips 35 of first fastening material in the form of resilient plastic hooks 36 of the type produced under the trademark VELCRO.

Figure 3:
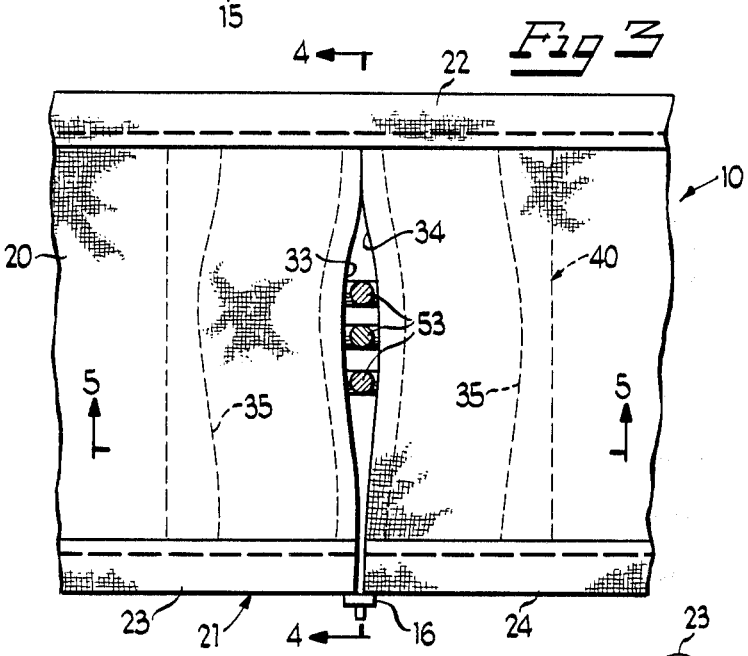
FIG. 3 is an elevational view partly in section of the garment bag illustrated in FIG. 1 as seen along line 3—3 thereof.

A flap 40 is comprised of two plies 41 and 42 of material connected at the edges of the end 43 of the flap being connected by the rear welt 22 to the rear panel 12 and the adjacent end of the gusset 20. The flap 40 is positioned, as best seen in FIG. 3, to extend from the rear panel 12 toward the front panel 11 and to be in registry with the strips 35 of the first fastening material. The flap 40 carries on the upwardly facing surface thereof a second fastening material 45 having a plurality of resilient plastic loops 46 of the type sold under the trademark VELCRO.

The garment bag 10 is of a size and dimension to accommodate a plurality of hangers 50 each having a hook portion 51 extending outside the garment bag 10 and a support portion 52 positioned within the bag 10, the hook portion 51 and the support portion 52 being connected by a neck portion 53 around which is positioned gusset 20 and flap 40, thereby to maintain and retain the hangers 50 in the desired position during storage or transit.

Figure 2:
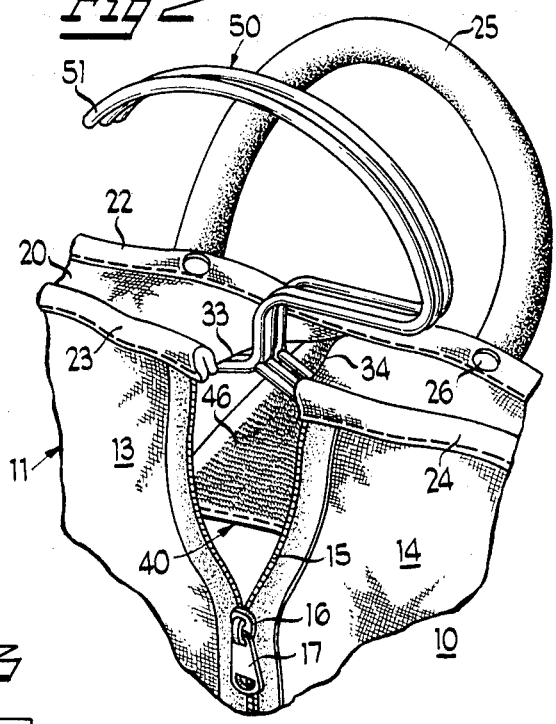
FIG. 2 is a figure like FIG. 1 with the garment bag closure partially open to show the relationship of the constituent parts thereof.
Figure 4:
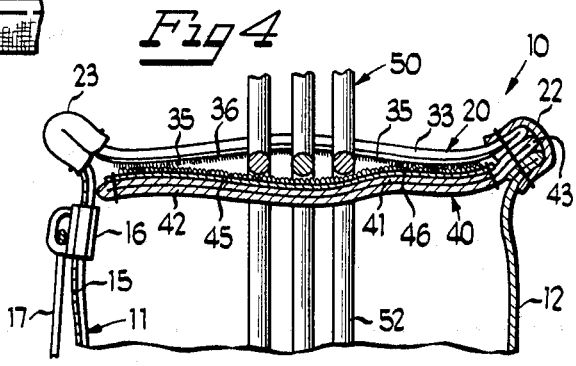
FIG. 4 is a view in section of the garment bag illustrated in FIG. 3 as seen along line 4—4 thereof.
Figure 5:
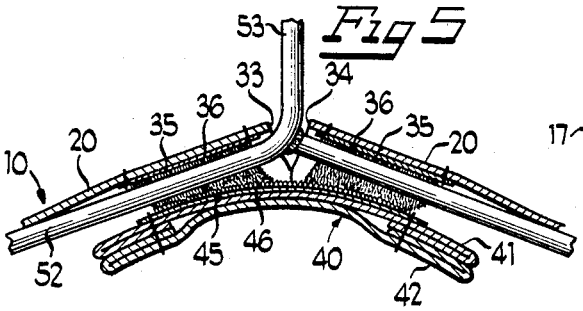
FIG. 5 is a view in section of the garment bag illustrated in FIG. 3 as seen along line 5—5 thereof.
Figure 6:
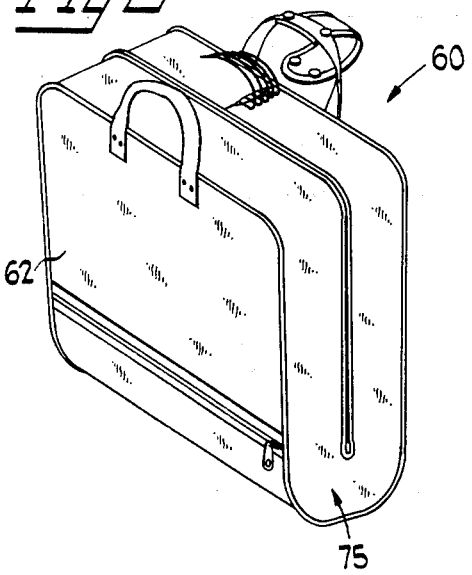
FIG. 6 is a perspective view of a second embodiment of the garment bag in the folded position.
Figure 8:
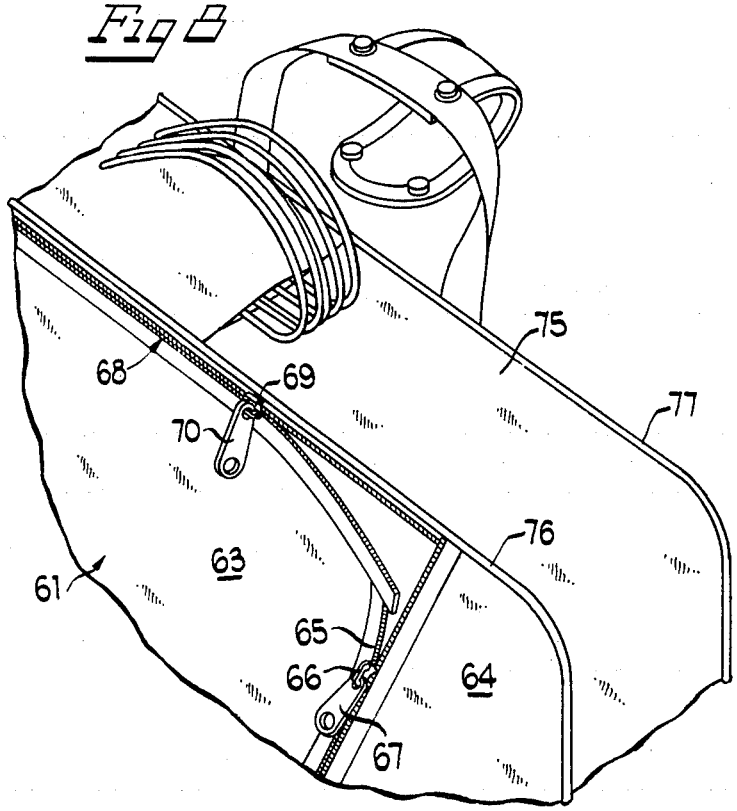
FIG. 8 is an enlarged fragmented perspective view of the dual zipper embodiment showing an upper portion of the garment bag with the dual zippers in a partially open position.
Figure 7:
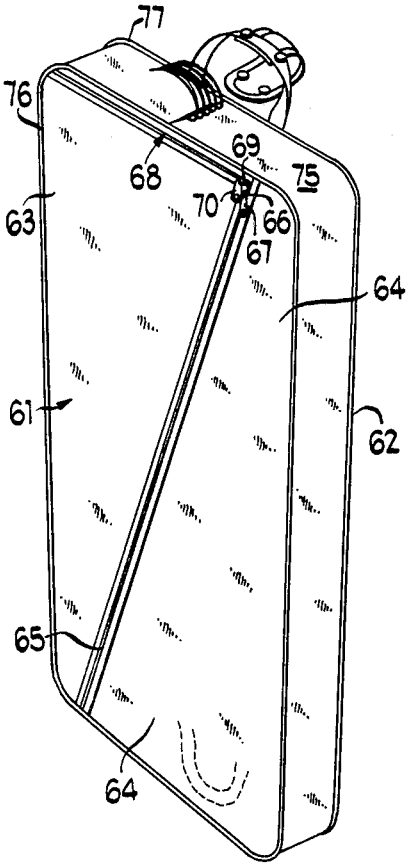
FIG. 7 is a perspective view of the second embodiment of the garment bag in the open position thereof showing the dual zipper embodiment.
Figure 9:
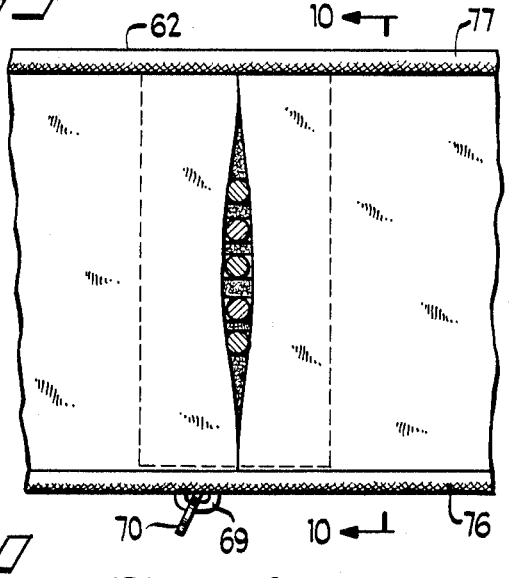
FIG. 9 is an elevational view partly in section of the center portion of the garment bag illustrated in FIG. 7.
Figure 10:
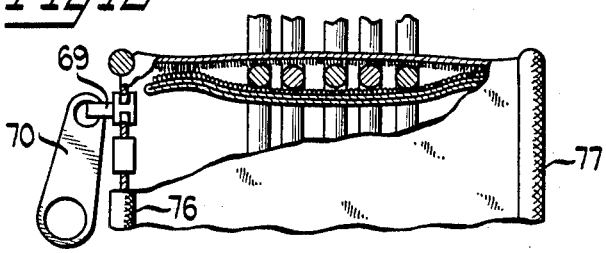
FIG. 10 is a fragmented, cross-sectional view taken along line 10—10 of FIG. 9.

In operation, the garment bag 10 is provided with a plurality of pockets or compartments, (not shown), in the usual manner and may be loaded as any other garment bag would be loaded. At this time the zipper 15 is open allowing access to the inside of the garment bag. After garments are hung on a number of the hangers 50, these hangers are positioned inside the garment bag 10. The flap 40, at this time, should be hanging freely from the rear panel 12 and after the hangers 50 are correctly positioned in the garment bag 10 with the necks 53 thereof extending between the end edges 33, 34 of the gusset 20, the flap 40 is moved upwardly as best illustrated in FIGS. 2, 4 and 5 to trap the hangers against the gusset. Strips of first fastening material 35 cooperate with the second fastening material 45 on the flap 40 to maintain the hangers 50 in position.

After the first fastening material 35 and the second fastening material 45 are interconnected, the end edges 33,34 of the gusset 20 snugly surround the neck portion 53 of the hangers 50 as seen in FIG. 3, securely to trap the hangers in position and to protect the garments inside the garment bag by substantially closing the bag. Thereafter, the zipper 15 can be moved to its closed position thereby completing closing of the garment bag 10, resulting in a substantially closed garment bag 10 with the hangers 50 firmly locked in position and the garments inside protected against wrinkling and the like due to dislodgement of the hangers during transit and against soiling due to the elements.

Additional features of the invention reside in the ease of use, the double ply construction of the flap 40, the uses of the hangers 50 and particularly the hook portions 51 thereof in combination with the handle 25 to provide a more secure grip, and the absence of a hanging hook on a long chain which normally results in an unsatisfactory construction.

When the garment bag 10 is desired to be opened, it is a simple matter to position the hangers 50 on an appropriate support, open the zipper 15, disengage the flap 40 from the gusset 20 and obtain complete free and easy access to the garments within the garment bag 10. Yet another advantage of the present invention is to the ease at which the garment bag may be removed from the garments if desired. In some prior art constructions, removal of the garments from the garment bag is made more difficult due to the presence of various locking mechanisms necessary to retain the hangers in position in the bag during transit, thereby resulting in more inconvenience when the garments are desired to be removed from the bag. All these problems have been obviated in the present invention by the closure design which permits the hangers 50 to be retained in position within the garment bag 10 without the necessity of any of the locking mechanisms normally associated with garment bags.

Referring now to the second embodiment as shown in FIGS. 6–10, there is illustrated a garment bag 60 having a front panel 61 and a rear panel 62 generally parallel to one another, the front panel 61 having a section 63 and a section 64 interconnected by an oblique zipper 65. The oblique zipper 65 is provided with the usual slider 66 and pull tab 67. The front panel 61 also has a horizontal zipper 68 positioned adjacent the top edge of the section 63. The horizontal zipper 68 is likewise provided with a slider 69 and pull tab 70.

The front panel 61 and the rear panel 62 are separated by a gusset 75 which connects the front panel 61 and the rear panel 62 at the peripheries thereof. The gusset 75 is connected respectively to the front panel 61 and the rear panel 62 by means of a front welt 76 and a rear welt 77. The horizontal zipper 68 lies adjacent the front welt 76 along the top of the bag 60.

The front welt 76 is of a one-piece construction corresponding to the two sections 23 and 24 of the first embodiment. In operation, the horizontal zipper 68 on the oblique zipper 65 are open allowing the section 63 to be folded back for easy access to the interior of the bag 60 for insertion and removal of clothing. The remaining details of the bag 60 are identical to the bag 10 described herein.

Although the fastening materials 35 and 45 disclosed herein are the type sold under the trademark VELCRO, it will be understood that other alternate materials may be easily used without departing from the true scope of the invention. Accordingly, there has been described herein an improved garment bag having a closure which meets all the objects of the present invention and provides a simplified yet improved garment bag construction. Although only two embodiments of the present invention have been described herein, it will be appreciated that various modifications and alterations may be made therein without departing from the true scope and spirit of the present invention which is intended to be covered by the claims appended hereto.

What I claim is:

1. A garment bag comprising a front panel and a rear panel connected at the peripheries thereof, a gusset extending transversely between and connecting said front and rear panels at the tops thereof, said gusset having two end edges extending generally perpendicularly to the front and rear panels, first fastening material along substantially the entire length of said gusset end edges on the inside facing surfaces thereof, and a flap attached to said rear panel extending toward said front panel having second fastening material on the surface thereof facing said gusset in registry with said first fastening material along substantially the entire length of said gusset end edges, said gusset and said first fastening material theron cooperating with said flap and said second fastening material thereon to trap and retain hangers inside said bag with the hanger hooks extending outside said bag and to seal said bag against dust and the like when said first and second fastening material is connected therealong.

2. The garment bag of claim 1, wherein said first and said second fastening material are selected from a plurality of closely spaced hooks and loops which interconnect on contact and are easily separated.

3. The garment bag set forth in claim 1, wherein said first fastening material is positioned on a pair of parallel strips along the end edges of said gusset.

4. The garment bag of claim 1, and further comprising a reinforcing welt at the juncture of said front panel and said gusset.

5. The garment bag of claim 4, and further comprising a zipper in said front panel dividing said front panel into two sections each of which is connected to a respective one of said gusset end edges.

6. The garment bag of claim 1, wherein said flap is constructed of multiple plies of material connected to said rear panel by a reinforcing welt.

7. A garment bag comprising a front panel and a rear panel connected at the peripheries thereof, a gusset extending transversely between and connecting said front and rear panels at the tops thereof, said gusset having two end edges extending generally perpendicularly to the front and rear panels, first fastening material along substantially the entire length of said gusset end edges on the inside facing surfaces thereof, and a flap attached to said rear panel extending toward the other of said front or rear panels having second fastening material on the surface thereof facing said gusset, in registry with said first fastening material along substantially the entire length of said gusset end edges, said gusset and said first fastening material thereon cooperating with said flap and said second fastening material thereon to trap and retain hangers inside said bag with the hanger hooks extending outside said bag and to seal said bag against dust and the like when said first and second fastening material is connected therealong, said first zipper positioned along the top of said front panel adjacent said gusset and said two end edges, said second zipper lying oblique to said first zipper, said first and second zipper intersecting.

8. The garment bag of claim 7, wherein the point where said first and second zipper intersect is adjacent the top edge of said front panel.

9. The garment bag of claim 8, wherein said second zipper extends from the top edge of said front panel to the bottom edge of said front panel.

* * * * *